United States Patent [19]

Chun et al.

[11] Patent Number: 4,713,079

[45] **Date of Patent: * Dec. 15, 1987**

[54] PARTICLES CONTAINING DIHALOHYDANTOIN BLEACH IN A DILUTED CORE

[75] Inventors: Kil Whan Chun, Wyckoff, N.J.; Clemens A. Kyllmann, Chicago, Ill.

[73] Assignee: Lever Brothers Company, New York, N.Y.

[ * ] Notice: The portion of the term of this patent subsequent to Nov. 17, 2004 has been disclaimed.

[21] Appl. No.: 815,413

[22] Filed: Dec. 31, 1985

[51] Int. Cl.[4] ..... D06L 3/00; D06L 3/06; C11D 9/42; A62D 3/00

[52] U.S. Cl. ..... 8/101; 8/108.1; 8/137; 252/97; 252/99; 252/102; 252/174; 252/186.25; 252/186.34; 252/187.2

[58] Field of Search ..... 252/97, 99, 186.25, 252/186.34, 187.2, 186.35, 102, 174; 8/137, 107, 108.1, 101

[56] References Cited

FOREIGN PATENT DOCUMENTS 993583 5/1965 United Kingdom .
1054243 1/1967 United Kingdom .

*Primary Examiner*—Josephine L. Barr
*Attorney, Agent, or Firm*—Milton L. Honig; James J. Farrell

[57] ABSTRACT

Hard spherical bleaching particles are disclosed the core of each particle comprising a dihalohydantoin bleach active, a buffer salt and a binder which mixture when dissolved in water provides a pH of less than 9.5. The core may be encapsulated within an outer coating. Fabric pinhole damage is substantially reduced when bleaching with the foregoing particles.

20 Claims, No Drawings

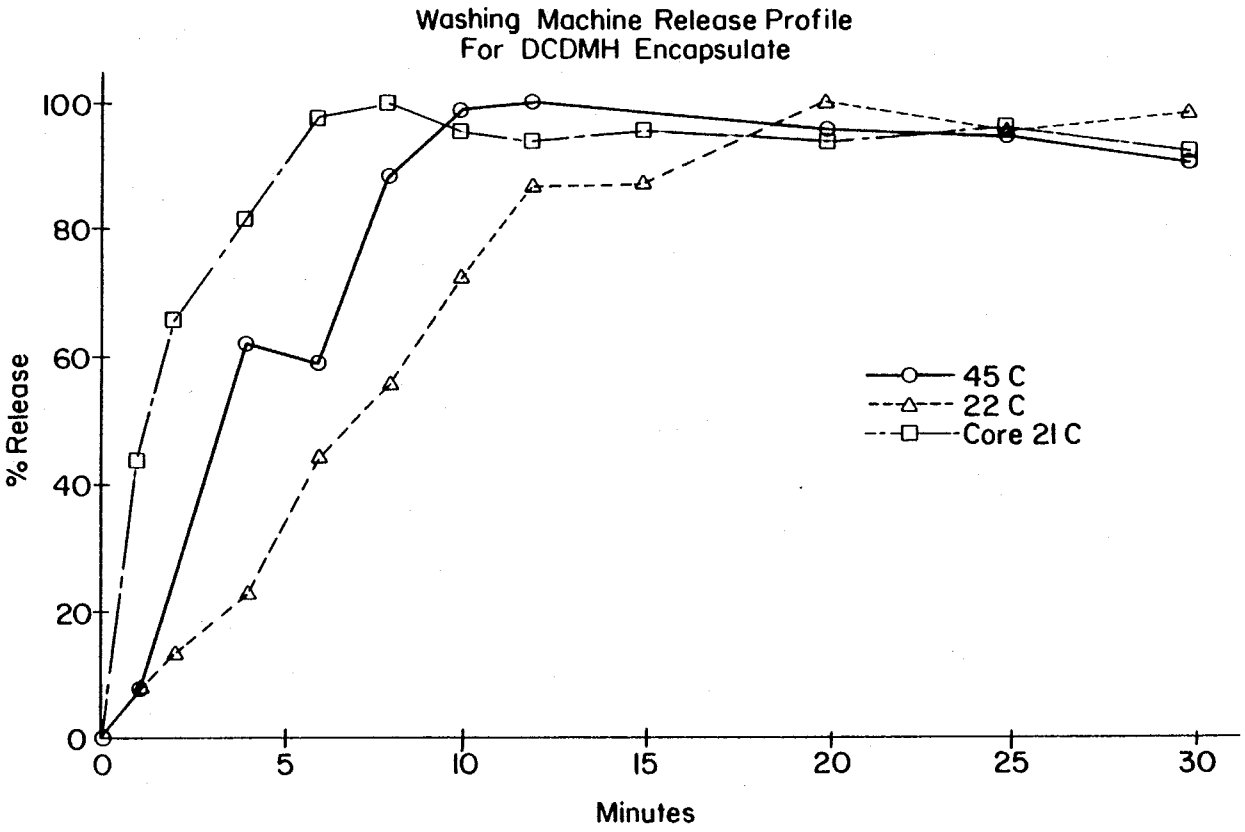
Washing Machine Release Profile
For DCDMH Encapsulate
45 C
22 C
Core 21 C
% Release
Minutes
0
20
40
60
80
100
0
5
10
15
20
25
30

PARTICLES CONTAINING DIHALOHYDANTOIN BLEACH IN A DILUTED CORE

BACKGROUND OF THE INVENTION

1. Field of the Invention

The invention relates to active halogen containing bleach particles and a method for bleaching substrates through slow uniform release of halogenating agent.

2. The Prior Art

Chlorine bleaches are well known for their efficacy in cleaning and removing stains. For instance, in the fabrics washing area liquid hypochlorite solutions have gained a preeminent position in the market. These solutions, however, have one major deficiency. Liquid hypochlorite solutions are sufficiently potent that at high use levels they are known to damage colored fabrics. Typically, a consumer doses approximately one cup of 5.25% hypochlorite solution to a wash load. Concentrations of approximately 160 ppm available chlorine are thus present in the wash liquor.

It has been determined that chlorine contents of 30–40 ppm available chlorine do not attack colored fabrics to any great extent. Achievement of such limited concentrations require that release of active chlorine be controlled, particularly during the fill cycle of an automatic washing machine. Much research has focused upon coating or encapsulating chlorinating agents, e.g. dichloroisocyanurate granules, to obtain delayed slow release of active oxidant.

There are, however, also problems associated with encapsulated bleach particles. When used for cleaning clothes in automatic washing machines, the detergent will occasionally be trapped in the fold of a fabric. Dissolution and dissipation of the bleach to the bulk of the wash bath is interfered with. Local high concentrations of bleaching actives thereby come into contact with fabric surfaces. Under these conditions of entrapment, very small spots of severe localized dye damage resembling pinholes appear on the fabric.

U.S. Pat. No. 4,136,052 (Mazzola) reports to have solved the pinhole problem caused by localized high concentrations of bleach. The patent provides a special coating which encapsulates the bleaching compound. An active chlorinating agent is surrounded by a first non-reactive coating combination of fatty acid and wax. A second coating is applied containing fatty acid with a material exhibiting inverse aqueous solubility with respect to temperature. The outer, second coating is more resistant to dissolution in hot than in cold water. By this means, sufficiently delayed bleach release is provided in hot water to prevent pinholing.

U.S. Pat. No. 3,908,045 (Alterman et al.) discloses dichloroisocyanurate salts encapsulated with a first coating of a saturated fatty acid surrounded by a second coating of soap. The latter coating is formed by treatment of portions of the inner fatty acid shell with a solution of an alkali metal hydroxide.

Organic coating materials protect the bleaching agent in the foregoing patents. A slightly different approach is reported in U.S. Pat. No. 3,112,274 (Morgenthaler et al.). Inorganic salts such as sodium tripolyphosphate are applied in a fluidized bed to coat polychloroisocyanurate salts. The resultant encapsulated salts are said to be protected from decomposition by the attack of moisture, air or other reactive materials.

None of the prior art coatings surrounding the chlorine bleach provide adequate protection against pinhole type fabric damage for effective commercial exploitation, although protection is better at low and medium temperatures. Unfortunately, at hot wash temperatures above the melting point of the coating materials, pinholing is still a problem. To solve the problem, average coating weights have been increased by as much as 50% over the known art. Even these increased thicknesses do not ensure complete absence of pinholing at hot wash temperatures. Very thick coatings, which do control pinholing, are deficient because they nearly eliminate chlorine release at low wash temperatures.

Consequently, it is an object of the present invention to provide bleach particles which eliminate pinholing yet have satisfactory active halogen release at all wash temperatures.

Another object of this invention is to provide a method for bleaching various substrates including fabrics.

SUMMARY OF THE INVENTION

Hard spherical bleaching particles are provided whose composition is an intimately dispersed mixture having a core comprising:

(i) from about 1 to about 90% by weight of a dihalohydantoin having the molecular structure:

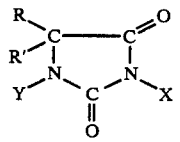

where

R and R′ may be the same or different and selected from $C_1$–$C_{12}$ alkyl, benzyl, aryl or $C_1$–$C_{12}$ alkyl substituted benzyl or aryl groups; and X and Y may be the same or different and chosen from chlorine or bromine;

(ii) from about 1 to 90% of a buffering salt; and (iii) from about 0.5 to 60% of an organic binder;

wherein the pH of said core is less than 9.5 when dissolved in water.

DETAILED DESCRIPTION OF THE INVENTION

It has been found that dihalohydantoins have an exceptionally low propensity to damage colored fabric in contrast to other chlorinating agents. For example, dichlorodimethyl hydantoin has been found to be less damaging than dichloroisocyanurate salts.

It has now also been found that certain benefits result when dichlorodimethyl hydantoin is compounded with inorganic filler to form the core of a bleaching particle. Dilution with filler provides a further assist to prevention of dye damage. The core particles are coherent, hard and spherical. They deliver high levels of bleaching agent. During subsequent coating processes, e.g. fluid bed treatment, the particles remain coherent; they do not readily break apart.

Moreover, these particles, when agitated, are readily soluble at all common wash temperatures. The structural arrangement of the diluted core particle aids in dispersing oxidant during dissolution in water. Protective coatings of only 25–30% by weight of the total particle are found to sufficiently prevent pinhole damage during the typical automatic washing machine 4-minute fill cycle, even at high wash temperatures. Thereafter, particles dissolve rapidly during the agitation cycle. High levels of bleaching agent are therefore available through most of the wash cycle.

A pH effect related to pinhole damage has also been noted. Where pH increases to about 9.5 or above, especially between 10 and 11, dye damage from entrapment will be maximized. The co-formulation of a buffer into the chlorine containing granule will tend to reduce the local pH; this prevents or ameliorates bleach damage. Accordingly, it is important to include a buffer within the diluted core particle of the present invention. Ideally, the buffer should maintain a pH between about 5 and 9, preferably between 6 and 8 at a concentration of about 3 g/in water.

Suitable buffering agents to be included within the core are salts of: dihydrogen phosphate, citrate and organic carboxylate-carboxylic acid salts such as sodium carboxymethyloxy succinic acid and polyacrylate.

At pH levels of 9.5 and above, dye damage increases from both the dihalohydantoins and the dichloroisocyanurates. Hydantoin containing encapsulates, however, always give a lower degree of entrapment damage at any pH value than do the dichloroisocyanurates. Hence, the combination of diluted core dichlorohydantoin at pH below 9.5 results in an unusually dye-safe oxidizing system while still providing excellent bleach performance.

Suitable hydantoins include: 1,3-dibromo and 1,3-dichloro-5,5-dimethyl hydantoin, N-monochloro-C,C-dimethylhydantoin methylene-bis(N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-isobutylhydantoin; 1,3-dibromo and 1,3-dichloro 5-methyl-5-n-amylhydantoin, and the like.

Particularly efficacious is the 1,3-dichloro-5,5-dimethyl hydantoin. The concentration of the dihalohydantoins may range from about 1 to 90%, preferably 30 to 70%; more preferably 40 to 60%.

It must also be understood that the hard spherical bleaching particles of this invention are not limited to their utility for washing fabric. They may also be used on dentures, floors, dishes and a variety of other hard or soft surfaces requiring cleaning with a controlled release oxidant.

When utilizing the particles of this invention in a fabric detergent formulation, the desired halogen level in a wash solution is about 10 to about 200 parts per million available chlorine. Preferably, the range is about 15 to 50 ppm for the most efficient utilization of halogen containing material. These levels determine the amount of bleach particles which must be incorporated into a detergent formulation.

A third essential element within the core particle is an organic binder. Suitable binders will vary with the particular process utilized for preparing the core particles. Binders should be blended in their fluid form when compounding the chlorine bleach and filler into particles. Hence, where the core particles are non-solvent processed, the binder may be blended with the other core components as a melt. This manner of incorporation requires that the binder have a melting point not exceeding the decomposition temperature of the chlorine bleach or other components of the core. Where solvents are utilized, such as in an agglomeration process, the binder should be soluble with a solvent used for blending the core components. In summary, the organic binder must be "blend compatible" with the core particle formation process.

Binders may be selected from chlorine bleach stable, water-soluble organic polymers or monomeric materials, examples of which are polyacrylates, ethylene-maleic anhydride derivatives and alkyl $C_{10}$–$C_{22}$ fatty acids. The binder must be a film forming or tacky material capable of binding particles together.

Among the organic homo-polymers and heteropolymers are a multiplicity of materials. Preferred, however, are the sodium salts of polyacrylic acid. Not only are these type of polymers excellent binders but they serve the additional function of controlling pH to a value of 10 or less. Polyacrylic acid salts are, thus, both binder and buffer. When this polymer is present, additional buffering agents need not be included within the core particle.

Binders within the definition of this invention must hold together the chlorine bleach/inorganic diluent within a core that is free-flowing and non-sticky. Free-flow properties may be measured by the DFR test as outlined in U.S. Pat. No. 4,473,485 (Greene), herein incorporated by reference.

The core of the bleaching particle may further contain a number of different inorganic salts employed as diluents. Examples include inorganic salts of: sulfates, carbonates, bicarbonates, borates, nitrates, orthophosphates, tripolyphosphates, silicates, chlorides, clays and zeolites. Sodium salts of the foregoing diluents are preferred. These salts must be inert to oxidation. Sodium sulfate is an especially preferred diluent for the core granules. The inorganic salt diluent may be present from about 1 to 90% by weight of the total granule, preferably from about 20 to 70%, more preferably from about 30 to 50%.

Diluted core bleach particles of the present invention may be further modified by encapsulation with one or more coatings. Several of the materials identified as binders may also be used as a coating material. Coatings are distinguished from binders in that the former are applied only after the core particles have been formed. Coatings may comprise from about 0.1 to about 50% by weight of total bleach particle. Preferably, the amount is from about 2 to 30%, more preferably 5 to 15%.

Long chain fatty acids and their alkali metal salt soaps have been recognized as useful coatings for delaying the release of chlorine bleach from core particles. These may be used with the present invention. Fatty acids and their soaps do have one major limitation. Laundering conditions encompass a broad temperature range. At high wash temperature, soaps and fatty acids coatings are not as effective as at lower temperatures. It has been found that certain organic polymers may be used in place of or in combination with soap to provide delayed release at all wash temperatures. These polymers will exhibit the property of resistance to dissolution during the fill cycle of a washing machine combined with susceptibility to dissolution in an aqueous basic detergent media. Examples of such materials include carboxylated polymers such as poly(styrene-co-maleic acid mono-$C_1$–$C_6$ alkyl ester), poly(ethylene co-maleic acid mono-$C_1$–$C_6$ alkyl ester), hydrolyzed ethylene-maleic anhydride copolymer, hydrolyzed styrene-maleic anhydride copolymer, vinylmethylether-maleic anhydride copolymer, cellulose acetate hydrogen phthalate, ethyl cellulose, methyl cellulose, polyvinylpyrrolidone, polyacrylic acid, polymethacrylic and styrene or maleic anhydride copolymers of acrylic or methacrylic acid. A preferred alkyl group is that of butyl for the maleic copolymer esters.

A further type of suitable coating is one exhibiting an inverse temperature-solubility relationship, i.e. those that withstand a washing machine hot fill cycle by virtue of their decreased solubility at higher temperature. These coatings will delay release of chlorine in a cold fill cycle but will also readily survive a hot filled cycle. Examples of such materials are hydroxybutyl methyl cellulose and hydroxypropyl cellulose.

The bleach particles and compositions of this invention may be applied to either flexible or hard substrates such as fabrics, dishes, dentures, tiles, toilet bowls and ceramic floors. Flexible substrates, specifically fabrics, will, however be focused upon in the subsequent discussion.

Bleach particles of the present invention may be incorporated into a detergent composition containing surfactants, soaps, builders, enzymes, filler materials and other minor functional laundering agents commonly found in such compositions.

Surfactants present in these detergent compositions may be found in an amount from about 2% to 50% by weight, preferably from 5 to 30% by weight. These surfactants may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxy alkane sulfonates.

The soaps are included within the definition of anionic surfactants. These include sodium and potassium salts of acyclic monocarboxylic acids having chain length of about 8 to about 22 carbon atoms. Particularly useful are the salts of unsubstituted fatty acids derived from natural triglycerides, such as tallow, palm oil, cottonseed oil, olive oil, lard, rapeseed oil, etc., and the so-called "high-lauric oils" generally exemplified by the tropical nut oils of the coconut oil class, including in addition to the coconut oil, palm kernel oil, babassu oil, ouricuri oil, tucum oil, cohune nut oil, and murumuru oil. Particularly useful soaps are prepared from the mixture of about 80% tallow and about 20% coconut oil.

Nonionic surfactants are water-soluble compounds produced by the condensation of ethylene oxide with a hydrophobic compound such as an alkanol, alkylphenol, polypropoxy glycol or polypropoxy ethylene diamine. Examples of nonionic surfactants are the condensation products of ethylene oxide, propylene oxide and/or butylene oxide with $C_8$–$C_{18}$ alkyl phenols, $C_8$–$C_{18}$ primary or secondary aliphatic alcohols, $C_8$–$C_{18}$ fatty acid amides. The average moles of ethylene oxide and/or propylene oxide present in the above nonionics varies from 1 to 30; mixtures of various nonionics, including mixtures of nonionics with a lower and a higher degree of alkoxylation may also be used.

Cationic surfactants include the quaternary ammonium compounds having one or two hydrophobic groups with 8–20 carbon atoms, e.g. cetyl trimethylammonium halide or methosulphate; dioctadecyl dimethylammonium halide or methosulfate; and the fatty alkyl amines.

Zwitterionic surfactants are water-soluble derivatives of aliphatic quaternary ammonium, phosphonium and sulphonium cationic compounds in which the alphatic moieties can be straight or branched, and wherein one of the aliphatic substituents contains from about 8 to 18 carbon atoms and one contains an anionic water-solubilizing group. Examples are alkyl dimethyl propane-sulfonates and alkyl dimethyl ammoniohydroxypropane-sulfonates wherein the alkyl group in both types contains from about 1 to 18 carbon atoms.

Conventional alkaline detergency builders, inorganic or organic, may be found in these compositions at levels from about 2 to 80%, preferably from 10 to 50% by weight. Inorganic builders include water-soluble alkali metal phosphates, polyphosphates, borates, silicates and carbonates. Organic builders include: (1) water-soluble amino polycarboxylates, e.g. sodium or potassium ethylene diamine tetraacetates, nitrilotriacetates and N-(2-hydroxy) ethyl nitrilodiacetates; (2) water-soluble salts of phytic acid; (3) water-soluble polyphosphonates such as salts of ethane-1-hydroxy-1,1-diphosphonic acid; methylene diphosphonic acid salts; ethylene diphosphonic acid salts and ethane-1,1,2-triphosphonic acids salts; (4) water-soluble salts of polycarboxylate polymers and copolymers. Certain aluminosilicates such as synthetic zeolites can also be used.

Adjunct materials commonly used in detergent compositions may be incorporated. These include soil suspending agents such as water-soluble salts of carboxymethyl cellulose, copolymers of maleic anhydride with vinyl ethers, and alkyl or hydroxyalkyl cellulose ethers. Other adjuncts include colorants, perfumes, lather boosters, anti-foam agents, optical brighteners, anti-oxidants and anti-corrosion inhibitors.

A number of processes have been developed for providing strong, coherent diluted core particles. One of these is called a rolling drum process. Therein, heated air is passed through a rolling drum filled with a mixture of dihalohydantoin, inorganic salt diluent and binder. Heat melts the binder which combines with the inorganic salt to wrap around the chlorine bleach and create a nearly spherical core agglomerate. The agglomeration effectively dilutes the chlorine content of the particles. Fatty acids within the melting point range of 30° C. (85° F.) to 50° C. (120° F.) are highly suited for use with this process; lauric acid is the preferred binder here. Experiments have been performed with a four foot long, two foot diameter rolling drum mixer having six inch spiral baffles. The drum is rotated at 32.5 rpm for about 10 minutes. A hot air gum is then set up to blow heated air through the drum to melt binder. When lauric acid is used, heat is removed after the drum reaches 43° C. Thereafter, it is cooled by rotation and particles are obtained therefrom having a hard, coherent, nearly spherical shape.

Extrusion/marumerization is another process for preparing the core particles. The process consists of thoroughly mixing the dihalohydantoin in the diluent inorganic compound and binder. The mixture is wetted with a solvent to form a paste-like material in the first step of the process. The paste is then extruded under high pressure in a second step. Homogeneous noodles are obtained. The noodles are placed in a marumerizer wherein they are formed into cylindrical particles. Thereafter, the particles are centrifuged at high speed to convert them from cylindrical into spherical shapes. The spherical particles may then be charged to a fluidized bed for encapsulation by coatings.

There are many coating processes that may be applicable to the diluted core particles. A preferred method is by spray coating of the core particles held in a fluidized bed. The preferred manner of application involves formation of a solution of the coating substance. A nozzle directs a spray of the coating solution at a fluidized bed containing the core particles to be coated. Either downward spray onto the fluidized bed or upward spray in a "Wurster" type arrangement are effective. The choice depends on the coating solvent and coating materials. Rapid drying rates are achieved by the large fluidizing air flow. The bed is also thereby kept in a loose, packed condition. These factors combine to minimize particle agglomeration and maximize the coating rate.

A third method for coating is through casting the coating from an aqueous solvent. Agglomerated core particles may readily be coated with soap by this method. Illustrative of the procedure is a 20% tallow/-coconut soap mixture dissolved in water at 70° C. The solution is sprayed onto dihalohydantoin diluted core particles being agitated in a fluidized bed, also at 70° C. Highly spherical particles with uniform coatings are obtained thereby.

The following examples will more fully illustrate the embodiments of the invention. All parts, percentages and proportions referred to herein and in the appended claims are by weight unless otherwise indicated.

EXAMPLE 1

This Example presents a comparison between sodium dichloroisocyanurate and dichlorodimethyl hydantoin containing diluted core particles. Table I reports the differences in dye damage between isocyanurate and hydantoin based bleach particles. These encapsulated cores contain equivalent amounts of "available chlorine". "Available chlorine" is the measure of the number of chemical equivalents of bleaching chlorine present. This value allows comparison between encapsulates made from chlorine compounds of different molecular weights.

Both encapsulates were prepared by blending the chlorine compound with sodium sulfate. Thereafter, the product was granulated into a core with an appropriate binder by extrusion-marumerization. Appropriate binders are those which yield coherent cores that dissolve rapidly in water. A mixture of tallow/coconut soap and polyvinylpyrrolidone was effective for the isocyanurate core. Sodium polyacrylate was effective for the hydantoin core. Different binders were required by the different physical properties of the chlorine source. Sodium isocyanurate is a water-soluble salt, whereas dichlorodimethyl hydantoin is a more organic solvent soluble material. The cores were then coated by spraying a solution of EMA-diacid onto the cores in a fluidized bed. Evaporation of the solvent left an EMA-diacid coating around the cores.

TABLE I

| Sample No. | Chlorine[a] Source | Coating[b] | Available Chlorine % | Evaluation: Folded Swatch (100° F.) | Evaluation: Washing Machine Entrapment[c] 70° F. | Evaluation: Washing Machine Entrapment[c] 130° F. |
|---|---|---|---|---|---|---|
| 1 | NaDCCA | EMA-diacid | 33 | Complete dye bleaching | 1.50 | 2.25 |
| 2 | DCDMH | EMA-diacid | 32 | No damage | 0 | 1.0 |

[a]Na—DCCA: sodium dichloroisocyanurate dihydrate
DCDMH: Dichlorodimethyl hydantoin
[b]EMA-diacid: hydrolyzed ethylene maleic anhydride copolymer
[c]Washing machine entrapment - Rating scale: 0 = no damage; 1 = trace; 2 = slight; 3 = moderate; 4 = heavy damage Composition

| | | | |
|---|---|---|---|
| Sample 1 | Core: | 70% | NaDCCA |
| | | 19% | $Na_2SO_4$ |
| | | 6% | (82:18) Tallow:Coco soap |
| | | 5% | Polyvinylpyrrolidone |
| | Coating:[a] | 9% | EMA - diacid |
| | | av.Cl. (by titration) = 33.4% wt. | |
| Sample 2 | Core: | 52.6% | DCDMH |
| | | 39.8% | $Na_2SO_4$ |
| | | 2.0% | Sodium lauryl sulfate |
| | | 1.0% | LiCL (tracer) |
| | | 4.6% | polyacrylic acid - NaSalt |
| | Coating:[a] | 9.4% | EMA - diacid |
| | | av.Cl. (by titration) = 32.4% wt. | |

[a]Percent coating is determined by averaging the percent weight gain on coating and the decrease in % available chlorine from core to encapsulate.

Evaluation

A. Folded Swatch Test

Five grams of encapsulate were placed in the center of a 4 inch square swatch of blue denim. The swatch was folded into a pouch such that the encapsulates were inside. Thereafter, the folded swatch was immersed in water at 38° C. (100° F.) for 15 minutes. The swatch was then unfolded, rinsed and examined. In severe damage, the dye will have been completely bleached leaving a 1–2 inch "white/yellow" spot in the area contacted by the encapsulate. Lesser damage will only fade the dye. The lesser the fading, the smaller the damage.

B. Washing Machine Entrapment

A regular washing machine was charged with a ballast load (about 6 lbs. cotton) and two large denim swatches (about 1 sq. yard each). These swatches were placed on top of the load. Encapsulates mixed with a typical commercial detergent powder were poured onto the denim.

The machine was filled on the "low" setting with water at the desired temperature and run on the "gentle"0 cycle. These conditions simulated an underfilled, overloaded machine. They maximize the potential for entrapment of encapsulate and detergent. Damage is thus exagerated. After the cycle was run, the denim swatches were removed and rated for damage (0=no damage, 4=heavy damage). Generally, damage was more severe at higher temperatures than at lower for any given encapsulate.

EXAMPLE 2

Another illustration of a bleach particle having a desirable chlorine release profile is that identified in Table II.

TABLE II

| Composition | Weight % of Core |
|---|---|
| Core (92.9%): | |
| Dichlorodimethyl hydantoin (100 mesh) | 50 |
| Polyacrylate binder | 8 |
| Silicone wetting agent | 2 |
| Sodium dihydrogen phosphate | 40 |
| Coating (7.1%): | |
| Hydrolyzed ethylene-maleic anhydride copolymer | |

In the foregoing formulation, polyacrylate served as binder and dihydrogen phosphate as buffer. Silicone wetting agent was not essential, but was useful in processing the core by the extrusion/marumerization method and provided uniform round granules. The chlorine release profile is shown in FIG. 1. The core, shown as the boxed line, has a delay from about 1 to 5 minutes in releasing chlorine. Encapsulation with hydrolyzed EMA 1103 successfully substantially delayed chlorine release in the 5 minute fill cycle. These particles then provided the desired 100% release within the wash cycle.

EXAMPLE 3

Bleach Effectiveness

Bleach performance can be measured in the laboratory with stain cloths that are known to have a sensitivity to chlorine. Two such cloths, a tea stained cloth and one known as EMPA 115, have been used to quantitatively compare bleach compositions under any given set of conditions.

Bleaching tests were conducted with a 4 pot Terg-o-Tometer from the U.S. Testing Company. Wash solutions were prepared from distilled water with hardness ions added to provide 60 ppm of calcium and magnesium (2:1), defined on a calcium carbonate basis. The wash volume was 1 liter. Temperature was maintained at 40° C. Agitation was provided throughout a 14 minute wash period.

Bleaching was monitored by measuring reflectance of dry cotton cloths (4"×6"). Prior to bleaching, the cloths were uniformly stained with either a tea solution or the EMPA 115 stain formula. These cloths were washed several times in a commercial detergent prior to their evaluation with bleach. Reflectance was measured on a Gardner XL-23 Reflectometer. The higher the reflectance, the greater the bleaching. Table III provides a general comparison of dichloroisocyanurate with two dihalohydantoins in terms of reflectance values.

TABLE III

Reflectance Changes for Bleaching of Standard Stains

| Stain | Dichloroisocyanurate | Bromo, Chloro, Dimethyl Hydantoin | Dichloro-Dimethyl Hydantoin |
|---|---|---|---|
| Tea | 17.4 | 8.0 | 11.5 |
| EMPA 115 | 12.7 | 20.6 | 12.1 |

From the results of the Table, it is clear that the dihalohydantoins are at least as effective as dichloroisocyanurate at removing EMPA 115 type stain. Bleaching effectiveness against tea stains was better with the dichloroisocyanurate than the dihalohydantoins. However, the latter materials provide levels of bleaching that are still very good.

The foregoing description and examples illustrate selected embodiments of the present invention and in light thereof various modifications will be suggested to one skilled in the art, all of which are within the spirit and purview of this invention.

What is claimed is:

1. Hard spherical bleaching particles whose composition is an intimately dispersed mixture having a core comprising:

(i) from about 1 to about 90% by weight of said core of dihalohydantoin having the molecular structure:

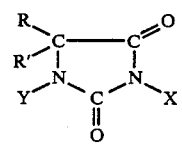

where

R and R' may be the same or different and selected from $C_1$–$C_{12}$ alkyl, benzyl, aryl or $C_1$–$C_{12}$ alkyl substituted benzyl or aryl groups; and X and Y may be the same or different and chosen from chlorine or bromine;

(ii) from about 1 to 90% by weight of said core of a buffering salt; and (iii) from about 0.5 to 60% by weight of said core of an organic binder;

wherein the pH of said core is less than 9.5 when dissolved in water.

2. Particles according to claim 1 wherein the chlorinating agent is dichlorodimethyl hydantoin or bromochlorodimethyl hydantoin.

3. Particles according to claim 1 wherein the dihalohydantoin is present from about 40% to about 60%.

4. Particles according to claim 1 wherein the binder is an organic polymer having carboxylate side chains.

5. Particles according to claim 1 wherein the binder is selected from the group consisting of $C_{10}$–$C_{20}$ fatty acid and alkali metal soaps thereof; polyacrylic or polymethacrylic acid, their salts or alkyl esters thereof; ethylene-maleic anhydride and its acid, salt or alkyl ester derivative thereof; and mixtures thereof.

6. Particles according to claim 1 wherein the buffer is selected from the group consisting of the salts of dihydrogen phosphate, citrate, bicarbonate and organic carboxylate-carboxylic acids.

7. Particles according to claim 1 wherein pH is maintained by the binder.

8. Particles according to claim 1 wherein the binder is present from about 1% to about 30%.

9. Particles according to claim 1 further comprising a diluent inorganic salt in an amount from about 1 to 90% by weight of the total core.

10. Particles according to claim 9 wherein the diluent inorganic salt is selected from the group consisting of salts of sulfate, carbonate, tripolyphosphate, bicarbonate, borate, nitate, orthophosphate, silicate, chloride, clay, zeolite and mixtures thereof.

11. Particles according to claim 1 further comprising at least one coating that encapsulates the core particles.

12. Particles according to claim 11 wherein the coating is present from about 0.1% to about 50%.

13. Particles according to claim 11 wherein the coating is present from about 5% to about 15%.

14. Particles according to claim 11 wherein the coating is selected from the group consisting of starches, gums, sugars, cellulose ethers, $C_{10}$–$C_{22}$ fatty acids, $C_{10}$–$C_{22}$ fatty acid soaps, and mixtures thereof.

15. Particles according to claim 11 wherein the coating is selected from the group consisting of poly(styrene-co-maleic acid mono-$C_1$–$C_6$ alkyl ester), poly(ethylene co-maleic acid mono-$C_1$–$C_6$ alkyl ester), hydrolyzed ethylene-maleic anhydride copolymer, hydrolyzed styrene-maleic anhydride copolymer, vinylmethylether-maleic anhydride copolymer, cellulose acetate hydrogen phthalate, ethyl cellulose, methyl cellulose, polyvinylpyrrolidone, polyacrylic acid, polymethacrylic, styrene or maleic anhydride copolymers of acrylic or methacrylic acid, and mixtures thereof.

16. A detergent composition comprising from about 0.5 to about 80% of the core particles according to claim 1 and from about 2 to about 50% by weight of a surfactant selected from the group consisting of anionic, nonionic, zwitterionic, amphoteric, cationic surfactants and mixtures thereof.

17. A detergent according to claim 16 further comprising from 2 to about 80% of an organic or inorganic builder salt.

18. A detergent according to claim 16 wherein the core particles are coated with an encapsulating material in the amount of 0.1% to 50% based on the total bleach particle weight.

19. A method for bleaching substrates comprising applying the bleach particles of claim 1 suspended in an aqueous medium to said substrate, said particles being present in an amount which will deliver about 10 to about 200 parts per million available chlorine to the aqueous medium.

20. A method according to claim 19 wherein the substrate is selected from the group consisting of fabrics, dentures, metals, ceramics, wood and dishes.

* * * * *